United States Patent [19]

Koiwai et al.

[11] Patent Number: 4,858,651

[45] Date of Patent: Aug. 22, 1989

[54] CONTROL VALVE FOR CONSTRUCTION EQUIPMENT

[75] Inventors: Hideshi Koiwai; Keiji Sekikawa, both of Saitama, Japan

[73] Assignee: Kayaba Industry Co. Ltd., Japan

[21] Appl. No.: 256,646

[22] Filed: Oct. 12, 1988

[30] Foreign Application Priority Data

Oct. 14, 1987 [JP] Japan ..... 62-157277[U]

[51] Int. Cl.[4] ..... F15B 13/02

[52] U.S. Cl. ..... 137/869; 60/452; 137/596.12

[58] Field of Search ..... 60/452; 137/596.12, 137/869

[56] References Cited

U.S. PATENT DOCUMENTS 3,788,077 1/1974 Johnson et al. ..... 60/452

FOREIGN PATENT DOCUMENTS 102561 9/1962 Netherlands ..... 137/596.12

*Primary Examiner*—Gerald A. Michalsky
*Attorney, Agent, or Firm*—Steinberg & Raskin

[57] ABSTRACT

A control valve for construction equipment adapted to operate a control mechanism in which a central by-pass passage is provided with a pilot pressure generating mechanism such as an orifice or the like and which is adapted to generate a pilot pressure due to pressure loss of fluid passed through the pilot pressure generating mechanism when a valve connected to the central by-pass passage is set at an open position, resulting the pilot pressure acting to control a discharge rate of a variable discharge pump. The control valve includes a valve body, in which a first spool and a second spool are arranged in series in such a manner that inner ends of the first and second spools are opposite to each other. An outer end of the second spool faces a second pilot chamber. A centering spring is arranged so as to act on an outer end of the first spool, so that the inner ends of both spools may be abutted against each other and received in a first pilot chamber when the spools are at their normal position. The application of a pilot pressure to the first pilot chamber causes the first spool to be moved against the centering spring to close the central bypass passage. Also, application of a pressure to the second pilot chamber causes both spools to be moved together to open a parallel passage.

1 Claim, 1 Drawing Sheet

CONTROL VALVE FOR CONSTRUCTION EQUIPMENT

BACKGROUND OF THE INVENTION

This invention relates to a control valve for a construction equipment, and more particularly to a control valve adapted to cause fluid to be supplied from a separate circuit system to a boom cylinder of a construction equipment to increase a speed of the cylinder.

Conventionally, a construction equipment has generally employed a system in which a plurality of control valves are connected to each of a pair of circuit systems. Each of the control valves connected to one of the circuit system is generally constructed in such a manner as shown in FIGS. 1 and 2.

More particularly, the control valve includes a first spool 2 provided in a valve body a so as to operate a central by-pass passage 1 and a second spool 3 arranged on a downstream side of the first spool 2 so as to carry out speeding-up and control of a boom cylinder.

The first spool 2 is so arranged that one end thereof faces a pilot chamber 4 and the other end thereof faces a spring chamber 5. Also, the first spool 2 is adapted to open the central by-pass passage 1 through an annular groove 6 when it is at its normal position shown in FIG. 2. When a pilot pressure is applied to the pilot chamber 4 to move the spool 2 against a spring 7, the central by-pass passage 1 is closed.

The second spool 3 has one end facing a pilot chamber 8 and the other end facing a spring chamber 9. When the second spool 3 is at its normal position shown in FIG. 2, the central by-pass passage is opened through a first annular groove 10 and a parallel passage 11 communicating with the boom cylinder (not shown) is closed. However, when a pilot pressure is applied to the pilot chamber 8 to move the spool 3 against a spring 12, the central by-pass passage 1 is closed and the parallel passage 11 is opened through a second annular groove 13.

When each of the spools 2 and 3 is held at the normal position shown in FIG. 1, the parallel passage 11 is closed and the central by-pass passage 1 is opened, so that fluid discharged from a pump (not shown) is supplied through an orifice 14 to a tank T. When fluid thus flows to the orifice 14, pressure loss occurs at the orifice 14 to generate a pressure on an upstream side of the orifice 14. The control valve causes the pressure produced on the upstream side to act on a control mechanism of a variable discharge pump (not shown) through a passage 15, resulting in decreasing a discharge rate of the discharge pump.

Then, when a pilot pressure is applied to the pilot chamber 4 of the first spool 2 to close the central by-pass passage 1, pressure loss through the orifice 14 is avoided, so that a pressure acting on the control mechanism of the variable discharge pump is decreased to zero to cause the discharge rate of the discharge pump to be maximized. An actuator connected to the circuit system is actuated by maximizing the discharge rate of the variable discharge pump.

When the second spool 3 is changed over irrespective of a switching position of the first spool 1, the central by-pass passage 1 is closed. This causes the discharge rate of the variable discharge pump to be maximized and fluid discharged from the pump to be supplied to the parallel passage 11. The fluid thus supplied to the parallel passage 11 is then supplied to the other circuit system.

The conventional control valve described above is required to provide the valve body a with the first spool 2 and the second spool 3 separately, so that it is required to form two spool holes in order to arrange the spools in the valve body. This causes manufacturing of the control valve to be highly troublesome. Also, this requires a large space to be formed in the valve for receiving the spools therein, resulting in complicating a structure of the valve and large-sizing the valve.

SUMMARY OF THE INVENTION

The present invention has been made in view of the foregoing disadvantage of the prior art.

Accordingly, it is an object of the present invention to provide a control valve for a construction equipment which is capable of facilitating its manufacturing.

It is another object of the present invention to provide a control valve for a construction equipment which is capable of simplifying its structure.

It is a further object of the present invention to provide a control valve for a construction equipment which is capable of being significantly small-sized.

It is still another object of the present invention to provide a control valve for a construction mechanism in which only one spool hole is required.

In accordance with the present invention, a control valve for a construction equipment is provided. The control valve is suitable for use for a construction equipment adapted to operate a control mechanism in which a central by-pass passage is provided with a pilot pressure generating mechanism such as an orifice or the like and which is adapted to generate a pilot pressure due to pressure loss of fluid passed through the pilot pressure generating mechanism when a valve connected to the central by-pass passage is set at an open position, resulting in the pilot pressure acting to control a discharge rate of a variable discharge pump.

The control valve includes a valve body, in which a first spool and a second spool are arranged in series in such a manner that inner ends of the first and second spools are opposite to each other. The control valve also includes a centering spring arranged so as to act on an outer end of the first spool. The valve body is formed therein with a second pilot chamber, and the second spool is so arranged that its outer end faces the second pilot chamber. The centering spring is adapted to generate elastic force acting on the first and second spools. Also, the valve body is formed therein with a first pilot chamber, which is so arranged so that the inner ends of the first and second spools abutted against each other are positioned in the first pilot chamber when the first and second spools are at their normal position. The first spool is adapted to close the central by-pass passage when it is moved against the centering spring due to a pressure in the first pilot chamber. The valve body is further formed therein with a parallel passage, and the first and second spools are adapted to close the central by-pass passage and open the parallel passage when they are moved due to a pressure in the second pilot chamber.

In the control valve of the present invention constructed as described above, the action of a pressure in the second pilot chamber on the end surface of the second spool causes the first and second spools to be moved together to close the central by-pass passage and open the parallel passage. Such closing of the central by-pass passage causes a pilot pressure from the pilot pressure generating mechanism to be zero, resulting in the discharge rate of the variable discharge pulp being maximized. Also, fluid is supplied to the parallel passage at the maximum discharge rate, so that an actuator connected to the parallel passage may be actuated. Further, application of a pilot pressure to the first pilot chamber causes only the first spool to be moved, resulting in the central by-pass passage being closed.

Thus, the control valve of the present invention requires only one spool hole because the first and second spools are arranged in series, to thereby significantly facilitate manufacturing of the valve and simplify a structure of the valve. Also, this leads to small-sizing of the valve.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENT

Figures 1, 2, 3:
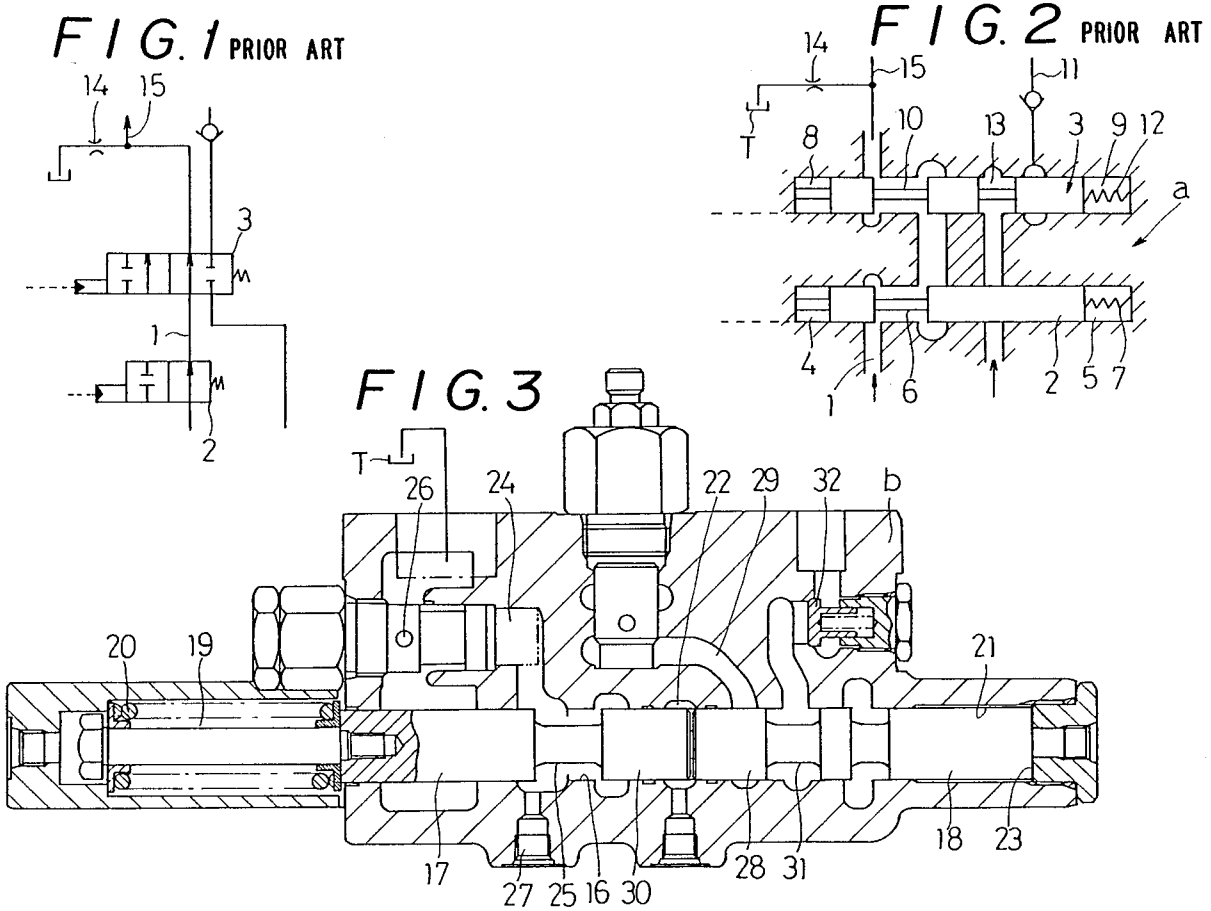
FIG. 1 PRIOR ART
FIG. 2 PRIOR ART
FIG. 1 is a circuit diagram showing a conventional control valve for a construction equipment.
FIG. 2 is a schematic view of the conventional control valve shown in FIG. 1.
FIG. 3 is a sectional view showing an embodiment of a control valve for a construction equipment according to the present invention.

Now, a control valve for a construction equipment according to the present invention will be described hereinafter with reference to FIG. 3.

A control valve of the embodiment shown in FIG. 3 includes a valve body b. The valve body b is formed therein with a through-hole 16 which serves as a single spool hole. The control valve also includes a first spool 17 and a second spool 18 arranged in series in the spool hole 16 in such a manner that inner ends of the spools 17 and 18 are opposite to each other.

The first spool 17 has an outer end facing a spring chamber 19 and the spring chamber 19 is provided therein with a spring 20 acting on the first spool 17. The second spool 18 has an outer end facing a second pilot chamber 21 formed in the valve body b. The above-described inner ends of both first and second spools 17 and 18 opposite to each other are arranged so as to face a first pilot chamber 22 formed in the valve body b.

The first and second spools 17 and 18 are so arranged that when they are at their normal position shown in FIG. 3 wherein any pilot pressure is not applied to the first and second pilot chambers 22 and 21, the spring 20 acts on both spools 17 and 18, resulting the inner ends being abutted against each other and the outer end of the second spool 18 being abutted against a terminal end 23 of the second pilot chamber 21. Also, when both spools 17 and 18 are at their normal position, the inner surfaces or ends of the spools abutted against each other are positioned in the first pilot chamber 22.

Further, when the spools 17 and 18 each are at the normal position, a central by-pass passage 24 is opened through an annular groove 25 formed at the first spool 17. This causes the central by-pass passage 24 to communicate with a tank T through an orifice 26 serving as a pilot generating mechanism. The orifice 26 communicates on an upstream side thereof through a passage 27 with a control mechanism for controlling a discharge rate of a variable discharge pump (not shown).

When the second spool 18 is at the normal position, a land 28 blocks communication with a parallel passage 29 formed in the valve body.

When each of the spools 17 and 18 is at the normal position shown in FIG. 3, fluid discharged from the variable discharge pump is supplied through the central by-pass passage 24 and orifice 26 to the tank T, so that a pressure on the upstream side of the orifice 26 acts on the control mechanism of the pump to minimize the discharge rate of the pump.

Then, when a signal pressure is applied to the first pilot chamber 22 in such a state as described above, the second spool 18 is forcedly pressed against the terminal end 23 of the second pilot chamber 21, resulting in being kept at the normal position. Whereas, the first spool 17 is moved against the spring 20 in a left-hand direction in FIG. 3, accordingly, a and 30 of the first spool 17 blocks communication with the central by-pass passage 24. Such interruption of communication with the central by-pass passage 24 causes a pressure on the upstream side of the orifice 26 to be zero, resulting in a pressure acting on the control mechanism of the variable discharge pump being zero. Thus, the discharge rate of the variable discharge pump is maximized.

Accordingly, supply of fluid discharged from the pump to an actuator (not shown) causes the actuator to be actuated.

When a pilot pressure is applied to the second pilot chamber 21 while each of the spools 17 and 18 is kept at the normal position, both spools 17 and 18 are moved together against the spring 20 to block communication with the central by-pass passage 24 and open the parallel passage 29 through an annular groove 31 of the second spool 28.

Thus, the discharge rate of the variable discharge pump is maximized for the same reason as described above and fluid is flowed through the parallel passage 29 and a load check valve 32 at the maximum discharge rate, resulting in an actuator connected to the parallel passage 29 being actuated.

As can be seen from the foregoing, the control valve of the illustrated embodiment is so constructed that the first and second spools 17 and 18 are arranged in series in the valve body b and abutted against each other. Such construction requires only one such spool hole 16 to be formed in the valve body 6, resulting in the control valve being significantly small-sized. Also, such construction permits elastic force of the spring 20 acting on the first spool 17 to be applied through the first spool 17 to the second spool 18, resulting in only one such spring 20 being required. This causes a space for mounting the spring in the valve body to be highly reduced, so that the control valve may be further small-sized.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A control valve for a construction equipment adapted to operate a control mechanism in which a central by-pass passage is provided with a pilot pressure generating mechanism and which is adapted to generate a pilot pressure due to pressure loss of fluid passed through said pilot pressure generating mechanism when a valve connected to said central by-pass passage is set at an open position, the resulting pilot pressure acting to control a discharge rate of a variable discharge pump, comprising:

a valve body;

a first spool and a second spool arranged in series in said valve body in such manner that inner ends of said first and second spools are opposite to each other;

a centering spring arranged in a manner to act on an outer end of said first spool;

first and second pilot chambers formed in said valve body;

said second spool having an outer end arranged so as to face said second pilot chamber;

said centering spring generating elastic force acting on said first and second spools;

said first pilot chamber being arranged so that said inner ends of said first and second spools abutted against each other are positioned in said first pilot chamber when said first and second spools are at their normal position;

said first spool closing said central by-pass passage when it is moved against said centering spring due to a pressure in said first pilot chamber; and a parallel passage formed in said valve body;

said first and second spools closing said central by-pass passage and opening said parallel passage when they are moved due to pressure in said second pilot chamber.

* * * * *